US008610486B1

(12) United States Patent
Al-Absi et al.

(10) Patent No.: US 8,610,486 B1
(45) Date of Patent: Dec. 17, 2013

(54) CURRENT-MODE ANALOG COMPUTATIONAL CIRCUIT

(71) Applicants: King Fahd University of Petroleum and Minerals, Dhahran (SA); King Abdulaziz City for Science and Technology, Riyadh (SA)

(72) Inventors: Munir A. Al-Absi, Dhahran (SA); Alaa A. Hussein, Dhahran (SA); Muhammad T. Abuelma'Atti, Dhahran (SA)

(73) Assignees: King Fahd University of Petroleum and Minerals, Dhahran (SA); King Abdulaziz City for Science and Technology, Riyadh (SA)

( * ) Notice: Subject to any disclaimer, the term of this patent is extended or adjusted under 35 U.S.C. 154(b) by 0 days.

(21) Appl. No.: 13/934,171

(22) Filed: Jul. 2, 2013

(51) Int. Cl.
*G06G 7/16* (2006.01)

(52) U.S. Cl.
USPC ..... 327/356; 327/357; 327/360; 708/835; 708/844

(58) Field of Classification Search
USPC ..... 327/355–357, 360; 708/835, 844
See application file for complete search history.

(56) References Cited

U.S. PATENT DOCUMENTS 4,586,155 A * 4/1986 Gilbert ..... 708/835
5,966,040 A * 10/1999 Gai et al. ..... 327/357
2011/0291807 A1 12/2011 Law et al.

FOREIGN PATENT DOCUMENTS

CN 1976218 A 6/2007
CN 201113977 Y 9/2008

OTHER PUBLICATIONS

Kaedi, S.; Farshidi, E., "A new low voltage four-quadrant current mode multiplier," Electrical Engineering (ICEE), 2012 20th Iranian Conference on , vol., no., pp. 160,164, May 15-17, 2012.*
Al-Absi, M.A.; Hussein, A.; Abuelma'atti, M.T., "A novel current-mode ultra low power analog CMOS four quadrant multiplier," Computer and Communication Engineering (ICCCE), 2012 International Conference on , vol., no., pp. 13, 17, Jul. 3-5, 201.*
Andreou et al., "Current-Mode Subthreshold MOS Circuits for Analog VLSI Neural Systems," IEEE Transactions on Neural Networks, vol. 2, No. 2, Mar. 1991, pp. 205-213.
A. Boura, M. Husak, "NMOS and PMOS translinear multiplying cell for current-mode signal processing," In Proceedings of the Seventh International Conference on Advanced Semiconductor Devices and Microsystems (2008), pp. 83-86.

(Continued)

*Primary Examiner* — Patrick O'Neill
(74) *Attorney, Agent, or Firm* — Richard C. Litman

(57) ABSTRACT

A current-mode analog computational circuit can be controlled to produce multiplying, squaring, divider and inverse functions and corresponding current outputs. The current-mode analog computational circuit is based on an implementation using MOSFETs operating in a sub-threshold region as can provide relatively ultra-low power dissipation. Furthermore, the current-mode analog computational circuit can be operated from a ±0.75 V DC supply. Tanner simulation results conducted using a 0.35-μm TSMC CMOS process confirmed the functionality of the multiplying, squaring, divider and inverse functions of the circuit. The current-mode analog computational circuit advantageously can have a total power consumption of 2.3 μW, a total harmonic distortion is 1.1%, a maximum linearity error of 0.3% and a bandwidth of 2.3 MHz.

12 Claims, 12 Drawing Sheets

(56) References Cited

OTHER PUBLICATIONS

C.-C. Chang, S.I. Liu, "Weak inversion four-quadrant multiplier and two-quadrant divider," Electron. Lett. 34 (22) , 2079-2080 (1998).

D. Coue, G. Wilson, "A four-quadrant subthreshold mode multiplier for analog neural network applications," IEEE Trans. Neural Netw. 7 (5) , 1212-1219 (1996).

M. Gravati, M. Valle, G. Ferri, N. Guerrini, L. Reyes, "A novel current-mode very low power analog CMOS four-quadrant multiplier," In *Proceedings of ESSCIRC*, France (2005), pp. 495-498.

W. Liu, S.I. Liu, Design of a CMOS low-power and low-voltage four-quadrant analog multiplier. Analog Integr. Circuits Signal Process. 63 (2) , 307-312 (2010).

* cited by examiner

1100

CURRENT-MODE ANALOG COMPUTATIONAL CIRCUIT

BACKGROUND OF THE INVENTION

1. Field of the Invention

The present invention relates to electronic circuits, and particularly to a current-mode analog computational circuit.

2. Description of the Related Art

The growing demand for portable operation of electronic systems and biomedical instruments has led to a trend of focusing on low-voltage and low-power designs. Current mode analog circuits are, therefore, very attractive candidates for portable applications where low power consumption and long battery life are key factors. This is because in current-mode circuits, the input and output signals are currents. Furthermore, the circuit performance is determined by currents and the voltage levels are generally irrelevant in determining the circuit performance. Typically, the nodes inside current mode circuits are low-impedance nodes. Thus, the voltage swings are usually small and, therefore, operation from low-voltage supplies is feasible. With low impedance nodes, the time constant of the circuits is relatively low and this results in wide bandwidth circuits. Moreover, in current-mode, the circuits' high gain is, in large part, not required. This results in simpler hardware structures and justifies the growing range of applications of the current-mode circuits, such as in neural networks, microwave and optical systems, continuous time filters and sampled data filters.

A conventional analog multiplier has been widely used as a basic building block in many analog signal processing applications, such as modulators, equalizers, frequency doublers and neural network applications. Existing methods to realize low power consumption in the circuit include using MOSFETs working in weak inversion.

One typical multiplier is a voltage-mode multiplier, with input voltages and an output voltage. This typical multiplier is usually very sensitive to temperature variations. Another typical circuit is a current-mode based circuit that utilizes conventional differential techniques. A major disadvantage of these current-mode based circuits is usually a requirement for a relatively large number of current sources. Another major disadvantage, for example, is a requirement for relatively large aspect ratios for most of the transistors. Consequently, these requirements can increase the cost of the circuit, and can increase power dissipation and degrade the bandwidth of the circuit.

Alternative designs for a four-quadrant multiplier circuit typically are not current-mode based. These alternative design four-quadrant multiplier circuits are usually transresistance based with the output voltage proportional to the multiplication of the input currents. Others alternative design four-quadrant multiplier circuits are usually transconductance based where the output currents are proportional to the input voltages. However, these typical designs can be relatively sensitive to temperature variations. Also, an example of a known single-quadrant multiplier circuit 20 as can be used in a four-quadrant multiplier circuit is shown in FIG. 2.

Thus, a current-mode analog computational circuit addressing the aforementioned problems is desired.

SUMMARY OF THE INVENTION

Embodiments of a current-mode analog computational circuit include a current-mode CMOS four-quadrant analog multiplier circuit. The current-mode analog computational circuit includes MOSFETs operating in the sub-threshold region to form translinear loops. Embodiments of a current-mode analog computational circuit can be configured to provide multiplier, squaring, divider and inverse analog computational functions. These functions, respectively, provide a multiplier function output current, a squaring function output current, a divider function output current and an inverse function output current. Furthermore, these four functions can be performed for direct current (DC) or alternating current (AC) signals and can be controlled using an external digital circuit to select one function at a time. Embodiments of a current-mode analog computational circuit can have less power consumption and a higher bandwidth and can be fabricated using n-well CMOS technology, for example.

These and other features of the present invention will become readily apparent upon further review of the following specification and drawings.

BRIEF DESCRIPTION OF THE DRAWINGS

Unless otherwise indicated, similar reference characters denote corresponding features consistently throughout the attached drawings.

DETAILED DESCRIPTION OF THE PREFERRED EMBODIMENTS

Figure 1:
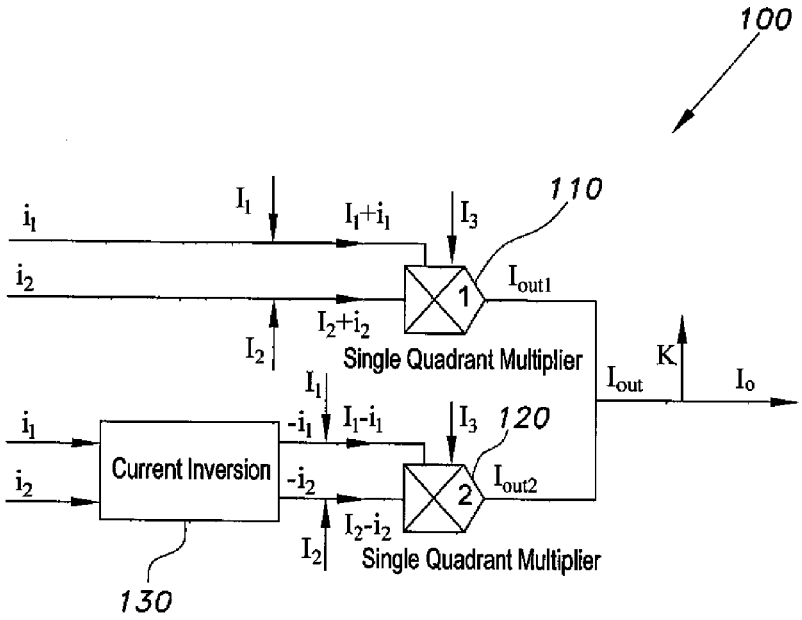
FIG. 1: is a block diagram illustrating embodiments of a current-mode analog computational circuit according to the present invention.
Figure 2:
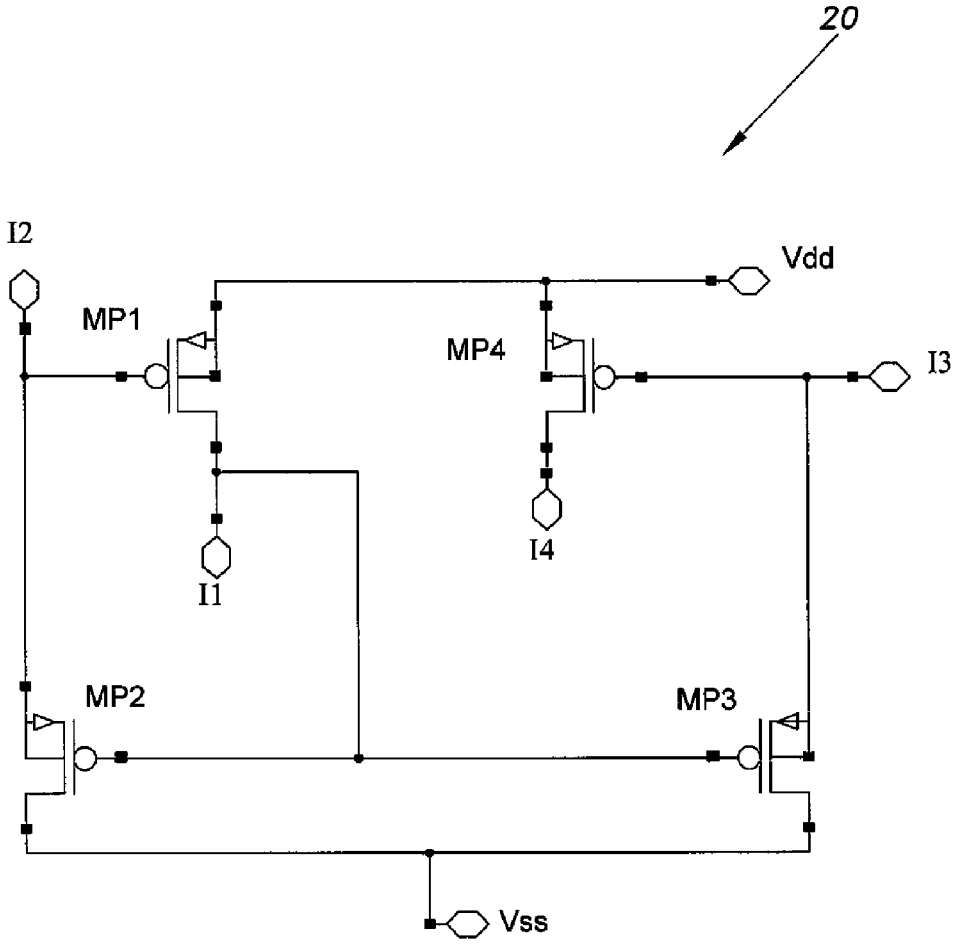
Prior Art Fig. 2
FIG. 2: is a schematic diagram of a single quadrant multiplier circuit as can be used in a current-mode analog computational circuit.

A schematic diagram of embodiments of a current-mode analog computational circuit 100 that can use low-voltage and low-power is shown in FIG. 1. The current-mode analog computational circuit 100 is typically a four-quadrant multiplier block circuit. The four-quadrant multiplier block circuit 100 can include a single-quadrant multiplier circuit that can be similar to the single-quadrant multiplier circuit 20 as shown in FIG. 2. The single-quadrant multiplier circuit 20 includes transistors MP1 through MP4 to form a translinear loop, with all MOSFETs operating in the sub-threshold region. Currents $I_1$, $I_2$, and $I_3$ are the input currents and $I_4$ is the output current. To provide a sub-threshold forward saturation mode of operation, two conditions typically must be satisfied. The first condition is that the drain current of any transistor must be less than the specific current $I_s$ given by:

$$I_s=2n\beta V_T^2. \tag{1}$$

The second condition is that the drain-to-source voltage of any transistor must be greater than $4V_T$.

In this regard, $V_T$ is the thermal voltage, $\beta=\mu_n C_{ox} W/L$, W is the channel width, L is the channel length, $C_{ox}$ is gate oxide capacitance per unit area, $\mu_n$ is mobility of the electrons in the channel, and n is a slope factor. This implies that the aspect ratios of all the transistors involved in the translinear loop must be selected to meet the anticipated dynamic range of the input and output currents. That is, for larger input and output currents, the aspect ratio, W/L, of all the transistors forming the translinear loop must be increased to meet the aforementioned first and second conditions.

Referring to FIG. 2, applying the translinear principle, with the transistors MP1 through MP4 working in the sub-threshold region, it is shown that:

$$I_{out1} = I_4 = \frac{I_1 I_2}{I_3}, \tag{2}$$

where, $I_{out1}$ is the output of the multiplier, $I_1$ and $I_2$ are the two input currents and $I_3$ is the bias current.

The four-quadrant multiplier block diagram of embodiments of a current-mode analog computational circuit 100, shown in FIG. 1, includes two single quadrant multiplier circuits (110, 120) as can be similar to the single-quadrant multiplier circuit 20 of FIG. 2. The current-mode analog computational circuit 100 further includes a current inversion circuit 130 to produce the inverted current signals for the second multiplier circuit 120.

Figure 3:
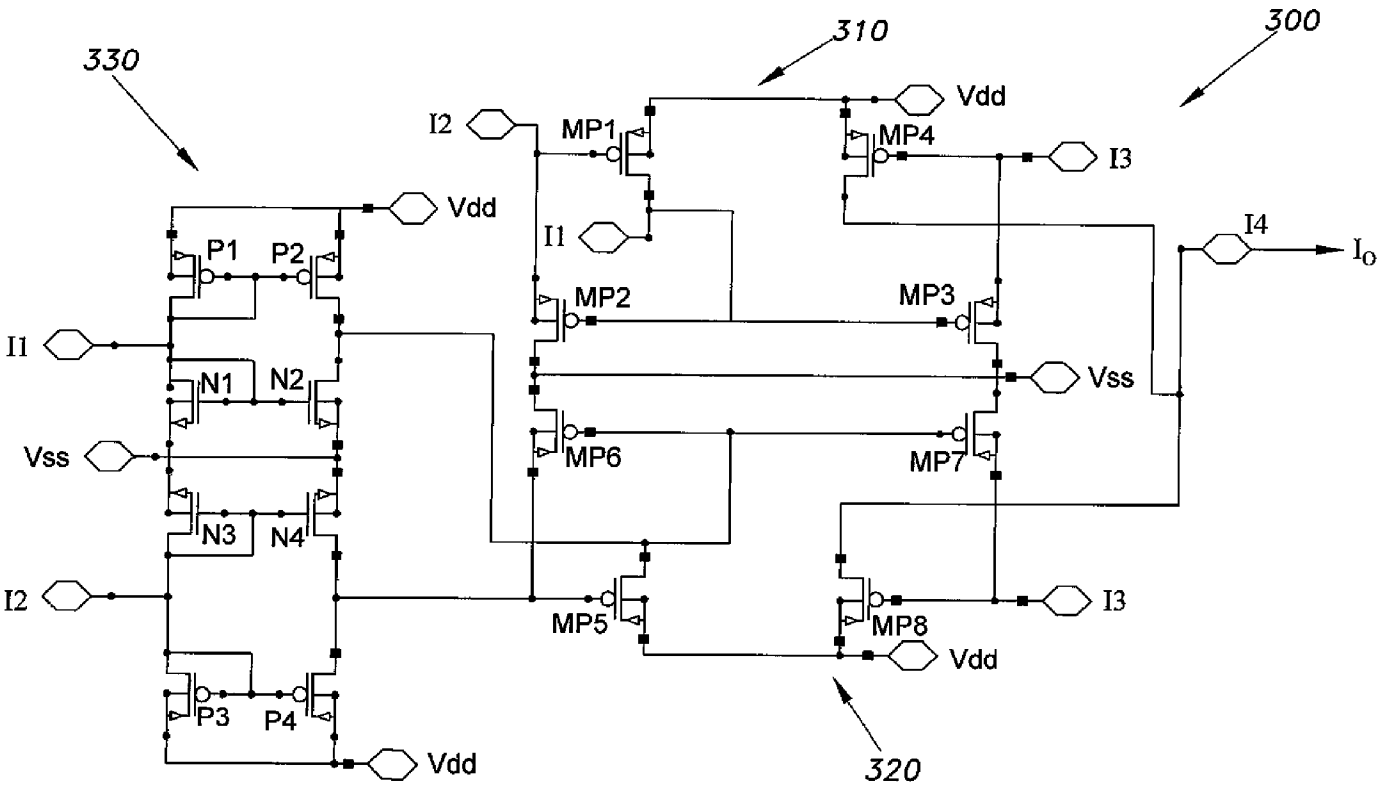
FIG. 3: is a schematic diagram of an embodiment of a current-mode analog computational circuit having a first and a second multiplier circuit and a current-inverting circuit according to the present invention.

With reference to the single-quadrant multiplier circuit 20 of FIG. 2 and the current-mode analog computational circuit 100 of FIG. 3, the AC input currents $i_1$ and $i_2$ are added to the DC input currents, $I_1$ and $I_2$, and the two input currents of the first multiplier circuit 110 can be written as $(I_1+i_1)$ and $(I_2+i_2)$, thus the output of the first multiplier circuit 110 is given by:

$$I_{out1} = \frac{(I_1+i_1)(I_2+i_2)}{I_3} = \frac{I_1 I_2 + I_1 i_2 + i_2 I_2 + i_1 i_2}{I_3}. \tag{3}$$

The output current of the second multiplier circuit 120, with currents $i_1$ and $i_2$ inverted, is given by:

$$I_{out2} = \frac{(I_1-i_1)(I_2-i_2)}{I_3} = \frac{I_1 I_2 - I_1 i_2 - i_2 I_2 + i_1 i_2}{I_3} \tag{3}$$

Adding the two outputs of the single-quadrant multipliers, or the first and second multiplier circuits (110, 120), the output current $I_{out1}$ is given by:

$$I_{out} = I_{out1} + I_{out2} = \frac{2I_1 I_2}{I_3} + \frac{2i_1 i_2}{I_3}. \tag{5}$$

In embodiments of the current-mode analog computational circuit 100, Equation (5) can selectively implement four functions, namely a multiplying function, a squaring function, a dividing function and an inversing function. The four functions correspond to a multiplying function output current, a squaring function output current, a dividing function output current, and an inversing function output current, respectively. Furthermore, these four functions can be performed for DC or AC signals. These four functions can be controlled using an external circuit, such as a digital circuit, to select one function at a time, for example. Moreover, if operations are to be performed on DC currents only, then AC components of the current must be set to zero and vice versa. These features of embodiments of the current-mode analog computational circuit 100 can be attractive and advantageous for analog signal processing applications.

In regards to the multiplier function of embodiments of the current-mode analog computational circuit 100, if only an AC output current is required, then a DC current component, $$K = \frac{2I_1 I_2}{I_3},$$

may be subtracted from the output. Accordingly, the multiplying function output current $I_m$, will be proportional to the multiplication of the two AC input currents $i_1$ and $i_2$, which may be described by a multiplying function relation:

$$I_m = \frac{2}{I_3} i_1 i_2 = I_o. \tag{6}$$

Inspection of equation (6) shows that the multiplying function output current is proportional to the multiplication of the two AC input currents $i_1$ and $i_2$. Furthermore, the multiplying function output current may be scaled by the DC input current $I_3$, for example.

In regards to the squaring function of embodiments of the current-mode analog computational circuit 100, using equation (6), the squaring function output current $I_{sq}$ is obtained by forcing the two AC input currents $i_1$ and $i_2$ to be approximately equal. Accordingly, equation (6) may be simplified to a squaring function relation:

$$I_{sq} = \frac{2}{I_3} i_1^2 = I_o. \tag{7}$$

As given by equation (7), the squaring function output current $I_{sq}$ is proportional to the square of the AC input current $i_1$ and can be scaled by the DC biasing input current $I_3$, for example.

In regards to the divider function embodiments of the current-mode analog computational circuit 100, using equation (6), the divider function output current $I_d$ is obtained by maintaining the current $i_1$ at a constant value, setting $i_2$ as the dividend and setting $i_3$ as the divisor. Accordingly, equation (6) may be simplified to a divider function relation where $k_1=2i_1$:

$$I_d = k_1 \frac{i_2}{I_3} = I_o. \tag{8}$$

As described by equation (8), the divider function output current $I_d$ is proportional to the ratio between the two input currents $i_2$ and $I_3$, and the ratio can be scaled by the current $i_1$, for example.

In regards to the inverse function of embodiments of the current-mode analog computational circuit 100, it is a modified version of the divider function. It can be obtained by keeping $i_1$ and $i_2$ constant and making $I_3$ as the input signal. Equation (6) then reduces to a divider function relation where $k_2=2i_1i_2$ given by:

$$I_i = k_2 \frac{1}{I_3} = I_o. \tag{9}$$

As described by equation (9), the inversing function output current $I_i$ is proportional to the inverse of the input current $I_3$ and can be scaled by the currents $i_1$ and $i_2$, for example.

An embodiment of the current-mode analog computational circuit 100 is illustrated in embodiment of a current-mode analog computational circuit 300, including a current inversion circuit 330, illustrated in FIG. 3. In the current-mode analog computational circuit 300, transistors MP1-MP8 implement the first and second multiplier circuits (310, 320, respectively), similar to the two single quadrant multiplier circuits (110, 120). Transistors P1-P4 and N1-N4 implement the current inversion circuit 330, similar to the current inversion circuit 130.

As illustrated in FIG. 3, in the current-mode analog computational circuit 300, the first multiplier circuit 310 includes a plurality of metal-oxide-semiconductor field-effect transistors (MOSFETs) MP1-MP4 that are configured to operate in a sub-threshold region to form at least one translinear loop, the first multiplier circuit 310 is configured to generate a first circuit output current related to a plurality of AC input currents, a plurality of DC input currents, and at least one DC biasing input current, for example.

The current inversion circuit 330 of the current-mode analog computational circuit 300 inverts a portion of the plurality of AC input currents to generate a plurality of inverted AC input currents.

The second multiplier circuit 320 includes a plurality of metal-oxide-semiconductor field-effect transistors (MOSFETs) MP5-MP8 configured to operate in a sub-threshold region to form at least one translinear loop, the second multiplier circuit 320 is configured to generate a second circuit output current related to the plurality of inverted AC input currents, the plurality of DC input currents, and the at least one DC biasing input current.

The current-mode analog computational circuit 300 generates a resulting output current including the first circuit output current and the second circuit output current, the resulting output current corresponding to a function output current, the function output current corresponding to at least one of a multiplying function output current, a squaring function output current, a divider function output current, and an inverse function output current, the function output current being related to the plurality AC input currents, the plurality of DC input currents, and the at least one DC biasing input current, as discussed.

Figure 4:
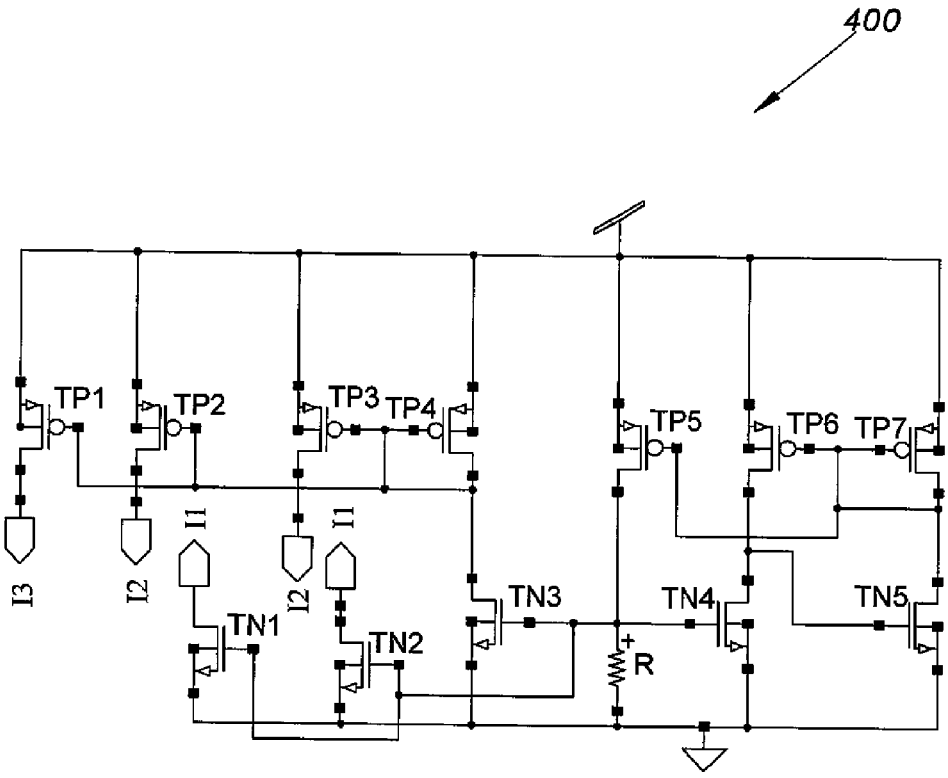
FIG. 4: is a schematic diagram of a biasing circuit for use with embodiments of a current-mode analog computational circuit according to the present invention.

The embodiment of the current-mode analog computational circuit 300 was simulated in relation to a multiplying function, a squaring function, a dividing function and an inversing function, the simulation results being illustrated in FIGS. 5-12. Both the layouts, and the post-layout simulations, were carried out using Tanner in 0.35-μm Taiwan Semiconductor Manufacturing Company (TSMC) process parameters. The DC currents $I_2$ and $I_3$ were set to 50-nA. In order to generate the 50-nA bias current, a supply-independent approach in the embodiment of a DC biasing circuit 400, as shown in FIG. 4, was used with R=60 K. The relatively successful operation of the circuit 400 was confirmed through the experimental testing, and a relatively stable bias current was obtained. Also, the multiplying function output current, the squaring function output current, the divider function output current, and the inverse function output current can be selected based on an input from an external circuit, such as the biasing circuit 400, to select at least one of a corresponding multiplying function, a squaring function, a divider function, and an inverse function.

In the simulation, the current $I_1$ was varied from −30-nA to 30-nA. The aspect ratios of all the transistors of the current-mode analog computational circuit 300 and the DC biasing circuit 400 used in the simulation are shown in Table 1. These ratios were chosen such that all the transistors involved in the translinear loops of FIG. 3 remain in the weak inversion mode for the entire input current range.

TABLE 1

| Transistor aspect ratios | | | | |
|---|---|---|---|---|
| | MP1-MP8 | P1-P4 | N1-N4 | TP1-TP7 |
| W/L | 10 μm / 5 μm | 1.7 μm / 5 μm | 1 μm / 5 μm | 5 μm / 2 μm |
| | TN1-TN3 | TN4 | TN5 | |
| W/L | 1 μm / 5 μm | 20 μm / 0.35 μm | 1 μm / 1 μm | |

Figure 5:
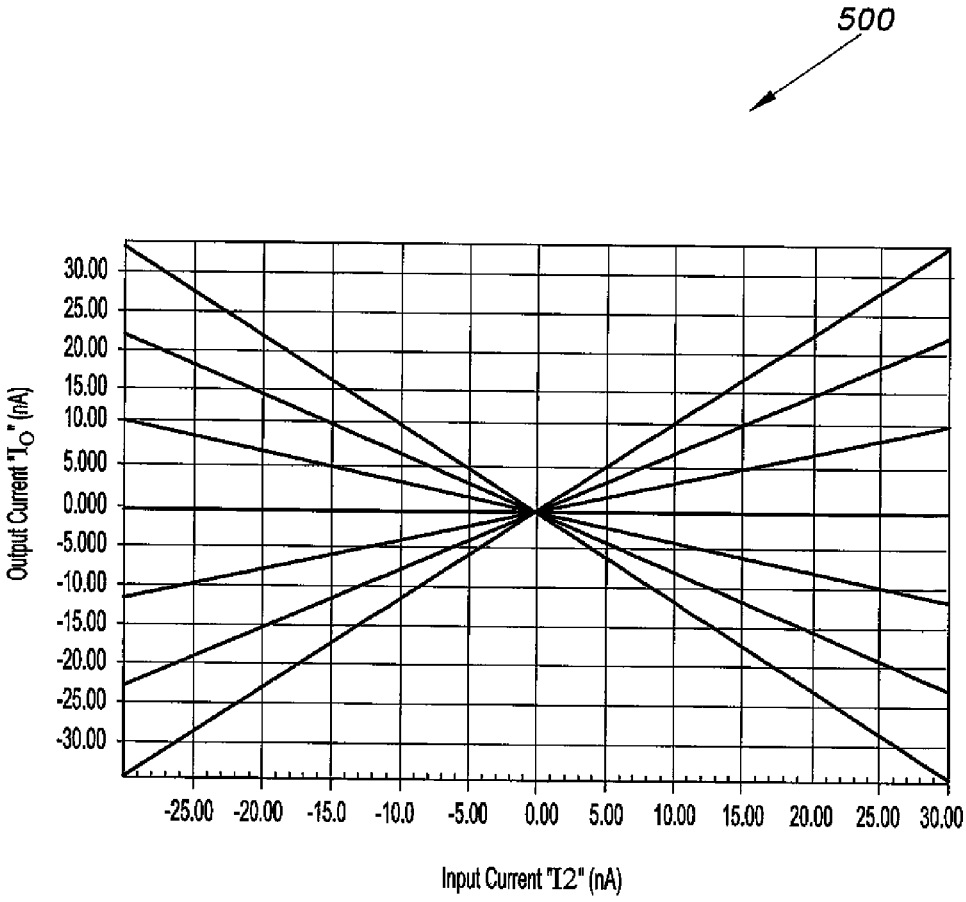
FIG. 5: is a graph showing a DC transfer characteristic of an embodiment of a current-mode analog computational circuit of FIG. 3 according to the present invention.

The DC transfer characteristic of the four-quadrant multiplier of the current-mode analog computational circuit 300 is shown in the plot 500 of FIG. 5. The plot 500 shows the post-layout DC transfer characteristic which verifies a proper operation of the current-mode analog computational circuit 300.

Figure 6:
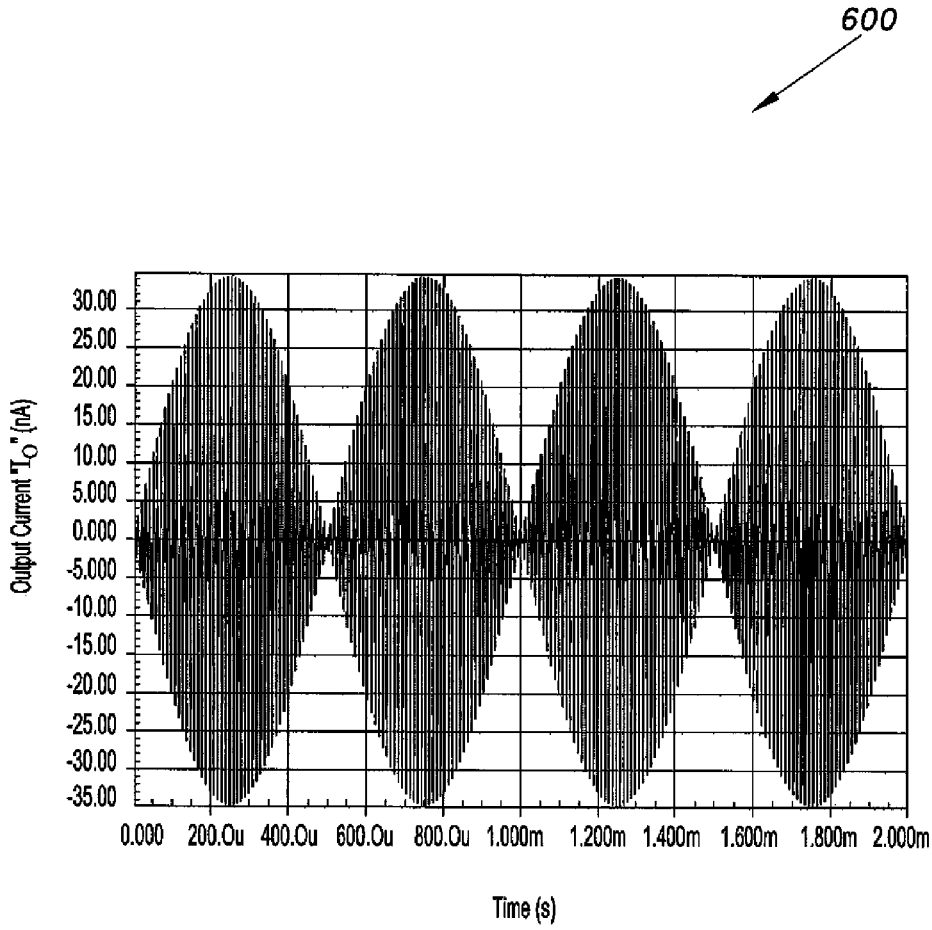
FIG. 6: is a graph showing amplitude modulating characteristics of an embodiment of a current-mode analog computational circuit of FIG. 3 according to the present invention.
Figure 7:
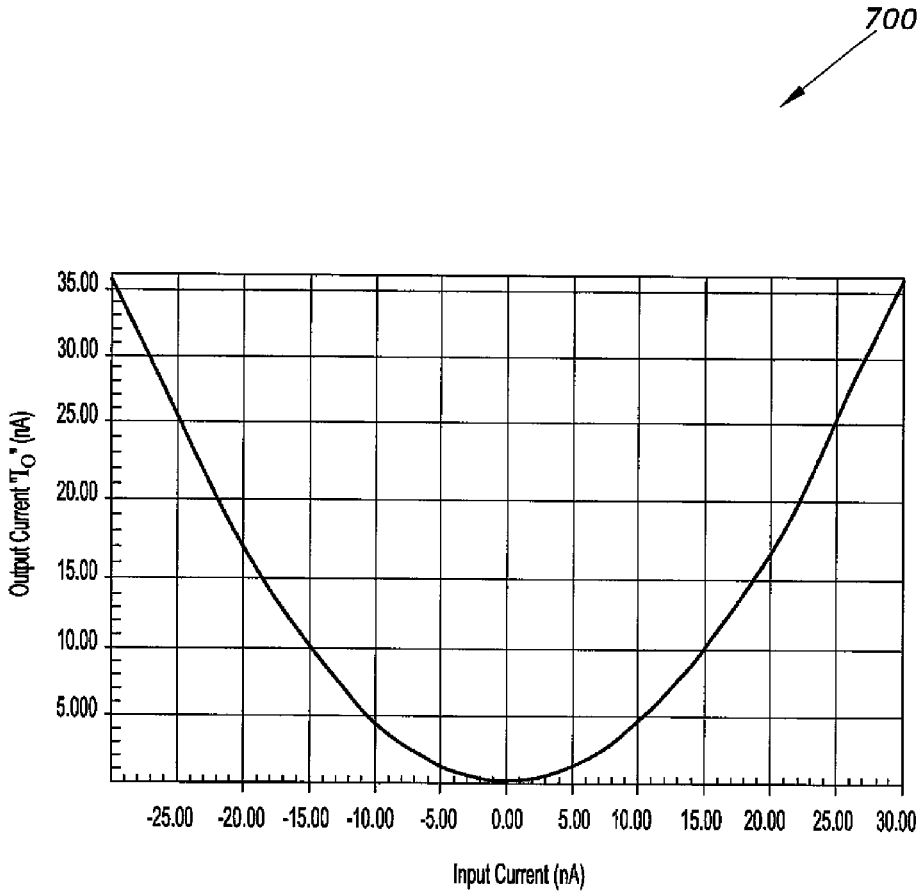
FIG. 7: is a graph showing simulation results of input versus output characteristics of a squaring function of an embodiment of a current-mode analog computational circuit of FIG. 3 according to the present invention.

FIG. 6 in the plot 600 demonstrates the use of the current-mode analog computational circuit 300 as a double-sideband suppressed carrier (DSBSC) amplitude modulator. These results were obtained with a sine-wave of 1-kHz frequency modulating a 100-kHz carrier frequency.

Additionally, the squaring function of the current-mode analog computational circuit 300 was verified by simulation. The simulation results, shown in the plot 700 of FIG. 7, verify a proper operation of the squaring function.

Figure 8:
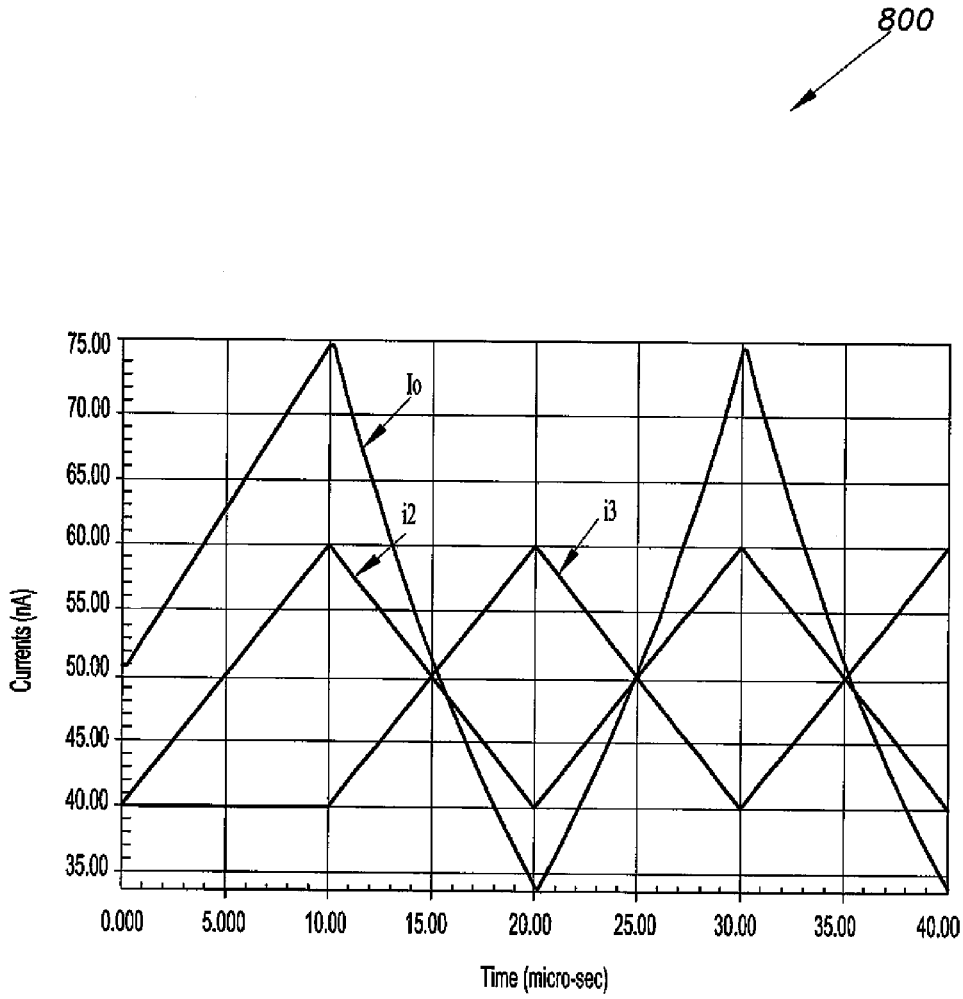
FIG. 8: is a graph showing simulation results of input versus output characteristics of a divider function of an embodiment of a current-mode analog computational circuit of FIG. 3 according to the present invention.
Figure 9:
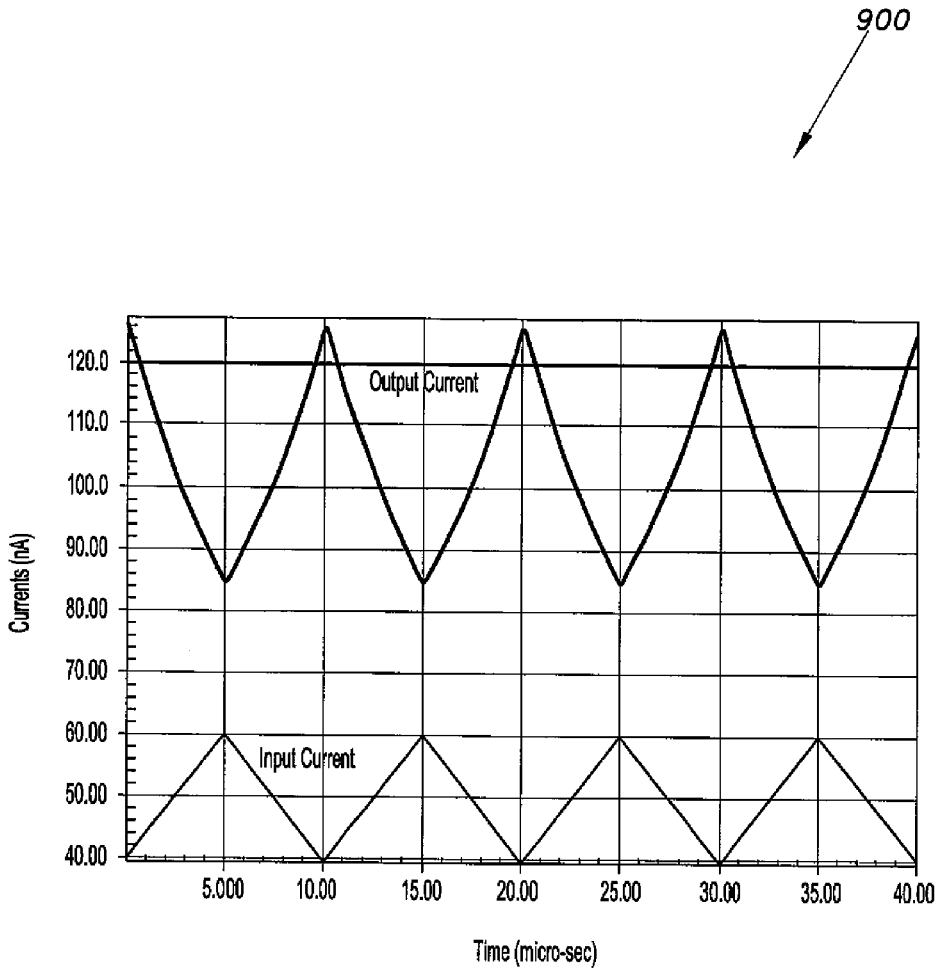
FIG. 9: is a graph showing simulation results of input versus output characteristics of an inverse function of an embodiment of a current-mode analog computational circuit of FIG. 3 according to the present invention.

Simulation of the divider function of the current-mode analog computational circuit 300 is shown in the plot 800 of FIG. 8. The simulation results, shown in the plot of FIG. 8, show an operation of the divider function. Simulation of the inverse function of the current-mode analog computational circuit 300 was also carried out and the simulation results are shown in the plot 900 of FIG. 9. The simulation results, shown in the plot of FIG. 9, show an operation of the inverse function. It is well known that it is not possible to divide by zero. For this reason, the input signal is shifted up by a 40-nA DC current, for example.

Figure 10:
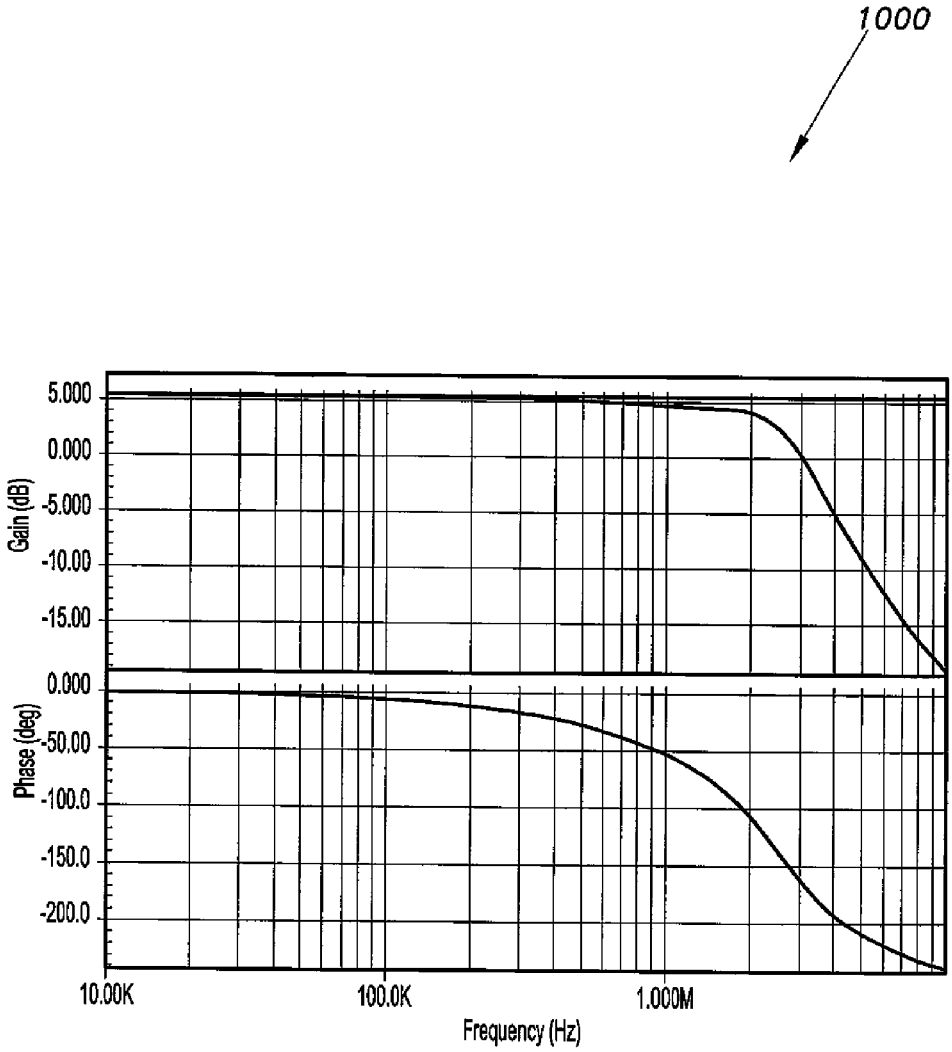
FIG. 10: is a graph showing a frequency response of an embodiment of a current-mode analog computational circuit of FIG. 3 according to the present invention.
Figure 11:
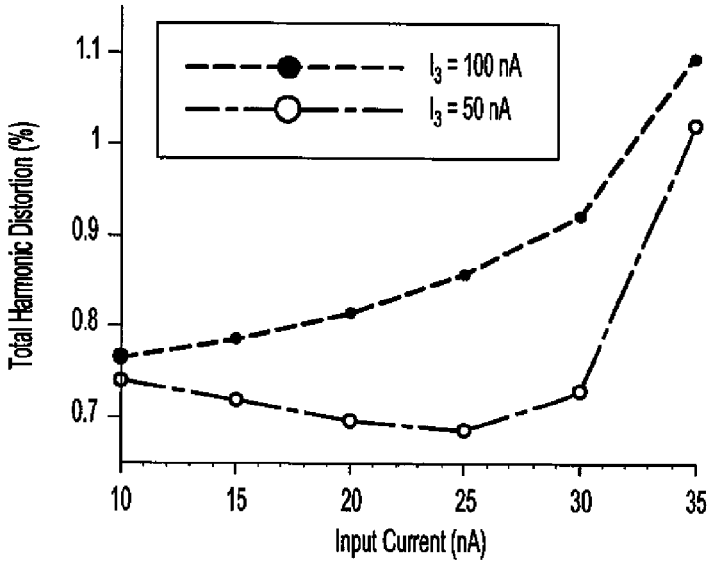
FIG. 11: is a plot showing a harmonic distortion of an embodiment of a current-mode analog computational circuit of FIG. 3 according to the present invention.
Figure 12:
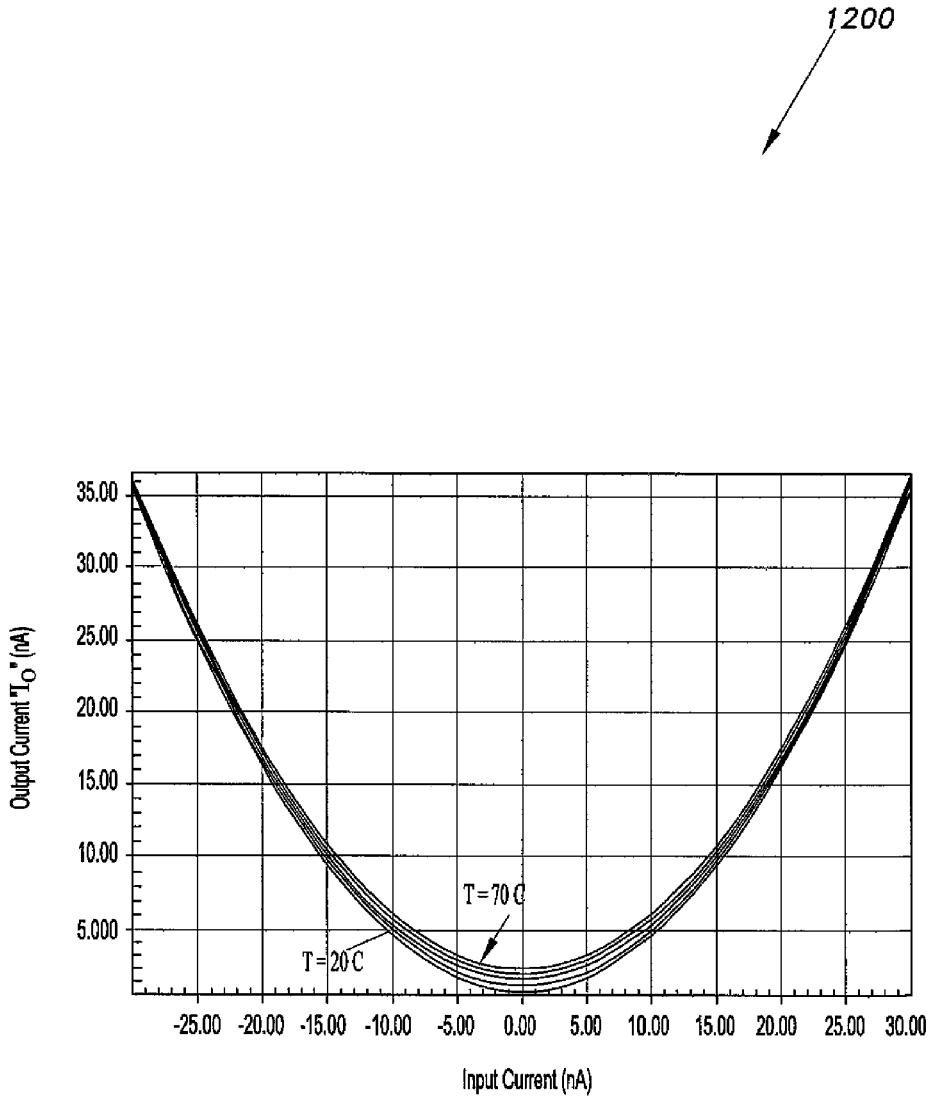
FIG. 12: is a graph showing effects of temperature variations of a squaring function of an embodiment of a current-mode analog computational circuit of FIG. 3 according to the present invention.

Also, a frequency response of the current-mode analog computational circuit 300 of FIG. 3 was investigated. A 10-kΩ resistor was used as the load. The −3 dB frequency was found to be approximately 2.3 MHz, as shown in the plot 1000 of FIG. 10. The offset in FIG. 10 is due to the factor 2 in equation (4). Simulation for the total harmonic distortion (THD) of the current-mode analog computational circuit 300 was carried out for the squaring function having the bias current $I_3$ set to 50-nA and 100-nA. The results are shown in the plots 1100 of FIG. 11. Inspection of the plots 1100 reveals that the total harmonic distortion is less than 1.1% at an input amplitude of 35-nA. The simulation was repeated for a 10% variation in supply voltage and the effects on THD and linearity was nearly negligible. The total power dissipation was found to be 2.3-μW. The maximum linearity error, calculated as the difference between simulated and calculated results, was found to be 0.3%.

Simulations of the effect of temperature variations on the squaring circuit performance of the current-mode analog computational circuit 300 were conducted. The temperature was varied from 20° C. to 70° C. The simulation result is shown in the plot 1200 of FIG. 12, which indicates that the effect of temperature variations is generally very small. However, it appears that the offset increases with the increase in temperature.

The simulation results for the multiplying, dividing, inverse and squaring functions of the current-mode analog computational circuit 300 are in substantial agreement with the aforementioned relations and calculations. A comparison between the performance of the embodiment of a current-mode analog computational circuit 300 and various known comparison circuits is depicted in Table 2. Comparison circuit 1 in Table 2 is described in M. Gravati et. al., "A novel current-mode very low power analog CMOS four-quadrant multiplier," in Proceedings of ESSCIRC, France (2005), pp. 495-498. Comparison circuit 2 in Table 2 is described in C.-C. Chang, S. I. Liu, "Weak inversion four-quadrant multiplier and two-quadrant divider," Electron Letter 34(22), 2079-2080 (1998). Comparison circuit 3 in Table 2 is described in W. Liu, S. I. Liu, "Design of a CMOS low-power and low-voltage four-quadrant analog multiplier," Analog Integrated Circuits Signal Process, 63(2), 307-312 (2010). As evidenced from Table 2, embodiments of the current-mode analog computational circuit have a relatively better performance than the comparison circuits 1-3 in terms of the total harmonic distortion (THD), linearity error, bandwidth and the power consumption.

TABLE 2

Performance Comparison with conventional approaches

| | Current-mode analog computational circuit | Comparison circuit 1 | Comparison circuit 2 | Comparison circuit 3 |
|---|---|---|---|---|
| Functions | Multiplying, Dividing, Squaring, and Inverse | Multiplying | Multiplying | Multiplying and Dividing |
| THD | 0.7% | 4.2% | 0.9% | NA |
| Linearity error | 0.3% | 3.2% | 5% | 3% |
| Bandwidth | 2.3 MHz | 268 kHz | 200 kHz | NA |
| Supply voltage | ±0.75 V | 1.5 V | 2 V | ±0.75 V |

TABLE 2-continued

Performance Comparison with conventional approaches

| | Current-mode analog computational circuit | Comparison circuit 1 | Comparison circuit 2 | Comparison circuit 3 |
|---|---|---|---|---|
| Power dissipation | 2.3 μW | NA | 5.5 μW | NA |
| Process used | 0.35 μm | 0.35 μm | 0.35 μm | 0.8 μm |

Embodiments of a current-mode analog computational circuit with low-voltage and low-power were described using MOSFETS operating in the sub-threshold region. Various embodiments of the current-mode analog computational circuit can be configured to implement multiplying, dividing, inverse and squaring functions. The design of the current-mode analog computational circuit is relatively easy to fabricate using a CMOS n-well process, for example. Post-layout simulation confirms the functionality of the multiplying, dividing, inverse and squaring functions.

It is to be understood that the present invention is not limited to the embodiments described above, but encompasses any and all embodiments within the scope of the following claims.

We claim:

1. A current-mode analog computational circuit, comprising:

a first multiplier circuit, wherein a plurality of metal-oxide-semiconductor field-effect transistors (MOSFETs) are configured to operate in a sub-threshold region to form at least one translinear loop, the first multiplier circuit configured to generate a first circuit output current related to a plurality of AC input currents, a plurality of DC input currents, and at least one DC biasing input current;

a current inversion circuit, wherein a portion of the plurality of AC input currents are inverted to generate a plurality of inverted AC input currents;

a second multiplier circuit, wherein a plurality of metal-oxide-semiconductor field-effect transistors (MOSFETs) are configured to operate in a sub-threshold region to form at least one translinear loop, the second multiplier circuit configured to generate a second circuit output current related to the plurality of inverted AC input currents, the plurality of DC input currents, and the at least one DC biasing input current; and wherein the current-mode analog computational circuit generates a resulting output current comprising the first circuit output current and the second circuit output current, the resulting output current corresponding to a function output current, the function output current corresponding to at least one of a multiplying function output current, a squaring function output current, a divider function output current, and an inverse function output current, the function output current being related to the plurality AC input currents, the plurality of DC input currents, and the at least one DC biasing input current.

2. The current-mode analog computational circuit according to claim 1, wherein the first multiplier circuit includes a first single quadrant multiplier configured to generate the first circuit output current described by the relation:

$$I_{out1} = \frac{(I_1 + i_1)(I_2 + i_2)}{I_3}$$

where $I_{out1}$ is the first circuit output current, $i_1$ is a first AC input current, $i_2$ is a second AC input current, $I_1$ is a first DC input current, $I_2$ is a second DC input current, and $I_3$ is the at least one DC biasing input current, the second multiplier circuit includes a second single quadrant multiplier configured to generate the second circuit output current described by the relation:

$$I_{out2} = \frac{(I_1 - i_1)(I_2 - i_2)}{I_3}$$

where $I_{out2}$ is the second circuit output current, $-i_1$ is an inversion of the first AC input current, $-i_2$ is an inversion of the second AC input current, $I_1$ is the first DC input current, $I_2$ is the second DC input current, and $I_3$ is the at least one DC biasing input current.

3. The current-mode analog computational circuit according to claim 1, wherein the resulting output current is described by the relation:

$$I_{out} = I_{out1} + I_{out2} = \frac{2I_1I_2}{I_3} + \frac{2i_1i_2}{I_3}$$

where $I_{out}$ is the resulting output current, $I_{out1}$ is the first circuit output current, $I_{out2}$ is the second circuit output current, $i_1$ is a first AC input current, $i_2$ is a second AC input current, $I_1$ is a first DC input current, $I_2$ is a second DC input current, and $I_3$ is the at least one DC biasing input current.

4. The current-mode analog computational circuit according to claim 1, wherein the multiplying function output current is implemented by subtracting a DC current component K, where $$K = \frac{2I_1I_2}{I_3},$$

from the resulting output current $I_{out}$, the multiplying function output current being proportional to the multiplication of first and second AC input currents described by a multiplying function relation:

$$I_m = \frac{2}{I_3} i_1 i_2$$

where $I_m$ is the multiplying function output current, $i_1$ is the first AC input current, $i_2$ is the second AC input current, and $I_3$ is the at least one DC biasing input current configured to scale the first and second AC input currents.

5. The current-mode analog computational circuit according to claim 4, wherein the squaring function output current is implemented by setting the first AC input current, $i_1$, approximately equal to the second AC input current, $i_2$, the squaring function output current configured to be proportional to a square of at least one of the first and second AC input currents and being described by a squaring function relation:

$$I_{sq} = \frac{2}{I_3} i_1^2$$

where $I_{sq}$ is the squaring function output current, $i_1^2$ is a product of the first AC input current $i_1$ and the second AC input current $i_2$, where $i_1$ is approximately equal to $i_2$ and $I_3$ is the at least one DC biasing input current configured to scale $i_1^2$.

6. The current-mode analog computational circuit according to claim 5, wherein the divider function output current is implemented by maintaining a constant value for the first AC input current, $i_1$, setting the second AC input current, $i_2$, as a dividend, and setting the at least one DC biasing input current, $I_3$, as the divisor, the divider function output current configured to be proportional to the ratio between the second AC input current, $i_2$, and the at least one DC biasing input current, $I_3$, and being described by a divider function relation:

$$I_d = k_1 \frac{i_2}{I_3}$$

where $I_d$ is the divider function output current, $k_1$ is a constant being equal in value to a product of $2i_1$, where the first AC input current, $i_1$, is configured to scale the ratio $$\frac{i_2}{I_3},$$

where $i_2$ is the second AC input current, and $I_3$ is the at least one DC biasing input current.

7. The current-mode analog computational circuit according to claim 6, wherein the inverse function output current is implemented by maintaining a constant value for the first and second AC input currents, $i_1$ and $i_2$, respectively, and configuring the at least one DC biasing input current $I_3$ as an input current $I'_3$, the inverse function output current being proportional to the inverse of the input current $I'_3$, and being described by an inverse function relation:

$$I_i = k_2 \frac{1}{I'_3}$$

where $I_i$ is the inverse function output current, $k_2$ is a constant being equal in value to a product of $2i_1i_2$, and where the first and second AC input currents, $i_1$ and $i_2$, respectively, are configured to scale the input current $I'_3$.

8. The current-mode analog computational circuit according to claim 1, wherein the squaring function output current is implemented by setting a first AC input current, $i_1$, approximately equal to a second AC input current, $i_2$, the squaring function output current configured to be proportional to a square of at least one of the first and second AC input currents and being described by a squaring function relation:

$$I_{sq} = \frac{2}{I_3} i_1^2$$

where $I_{sq}$ is the squaring function output current, $i_1^2$ is a product of the first AC input current $i_1$ and the second AC input current $i_2$, where $i_1$ is approximately equal to $i_2$, and $I_3$ is the at least one DC biasing input current configured to scale $i_1^2$.

9. The current-mode analog computational circuit according to claim 1, wherein the divider function output current is implemented by maintaining a constant value for a first AC input current, $i_1$, setting a second AC input current, $i_2$, as a dividend, and setting the at least one DC biasing input current, $I_3$, as the divisor, the divider function output current configured to be proportional to the ratio between the second AC input current, $i_2$, and the at least one DC biasing input current, $I_3$, and being described by a divider function relation:

$$I_d = k_1 \frac{i_2}{I_3}$$

where $I_d$ is the divider function output current, $k_1$ is a constant being equal in value to a product of $2i_1$, where the first AC input current, $i_1$, is configured to scale the ratio $$\frac{i_2}{I_3},$$

where $i_2$ is the second AC input current, and $I_3$ is the at least one DC biasing input current.

10. The current-mode analog computational circuit according to claim 1, wherein the inverse function output current is implemented by maintaining a constant value for first and second AC input currents, $i_1$ and $i_2$, respectively, and configuring the at least one DC biasing input current $I_3$ as an input current $I'_3$, the inverse function output current being proportional to the inverse of the input current $I'_3$, and being described by an inverse function relation:

$$I_i = k_2 \frac{1}{I'_3}$$

where $I_i$ is the inverse function output current, $k_2$ is a constant being equal in value to a product of $2i_1 i_2$, and where the first and second AC input currents, $i_1$ and $i_2$, respectively, are configured to scale the input current $I'_3$.

11. The current-mode analog computational circuit according to claim 1, wherein the multiplying function output current, the squaring function output current, the divider function output current, and the inverse function output current are selected based on an input from an external circuit to select at least one of a corresponding multiplying function, a squaring function, a divider function, and an inverse function.

12. The current-mode analog computational circuit according to claim 11, wherein the external circuit comprises a biasing circuit.

* * * * *